US007690541B2

(12) United States Patent
Pellegrini

(10) Patent No.: US 7,690,541 B2
(45) Date of Patent: Apr. 6, 2010

(54) ADJUSTABLE HOLSTER SECUREMENT DEVICE

(75) Inventor: Pietro Pellegrini, Fucecchio (IT)

(73) Assignee: Radar Leather Division S.r.l., Fucecchio (Florence) (IT)

( * ) Notice: Subject to any disclaimer, the term of this patent is extended or adjusted under 35 U.S.C. 154(b) by 1535 days.

(21) Appl. No.: 10/852,332

(22) Filed: May 23, 2004

(65) Prior Publication Data

US 2004/0251284 A1 Dec. 16, 2004

(30) Foreign Application Priority Data

May 23, 2003 (IT) ..... FI2003A0145

(51) Int. Cl.

| | |
|---|---|
| ***B65D 25/52*** | (2006.01) |
| ***B65D 39/08*** | (2006.01) |
| ***A45C 1/04*** | (2006.01) |
| ***A45F 3/00*** | (2006.01) |

(52) U.S. Cl. ..... 224/198; 224/197; 224/199; 224/673; 224/674

(58) Field of Classification Search ..... 224/198, 224/197, 199, 671, 672, 673, 674; 403/83, 403/101, 102, 111, 119, 123; 411/21, 27, 411/28

See application file for complete search history.

(56) References Cited

U.S. PATENT DOCUMENTS 6,161,741 A * 12/2000 French ..... 224/198

* cited by examiner

*Primary Examiner*—Nathan J Newhouse
*Assistant Examiner*—Lester L Vanterpool
(74) *Attorney, Agent, or Firm*—Pollack, P.C.

(57) ABSTRACT

An adjustable holster securement device which comprises a loop attachment for securing a holster to the belt of a user, a connection plate to which the holster is attached, and an articulated joint for connecting the loop attachment to the connection plate in an articulated manner. The articulated joint preferably comprises two substantially U-shaped members pivotably engaged with respective seatings on opposite sides thereof. The seatings are generally coaxial with, parallel to and integral with, respectively, the loop attachment and connection plate. At least one tie-rod is also provided, acting generally parallel to the seatings, for connecting the substantially U-shaped members to one another as well as a device for locking the articulated joint arranged between the substantially U-shaped members and the seating, the device being operable by the tie-rods to control locking and release of the articulated joint.

12 Claims, 5 Drawing Sheets

ADJUSTABLE HOLSTER SECUREMENT DEVICE

FIELD OF THE INVENTION

The present invention relates generally to accessories for hands-free use and securement of portable devices and, more particularly, to holsters and devices for adjustably securing the same to a users' belt.

BACKGROUND OF THE INVENTION

Law enforcement personnel, for instance, often use holsters, e.g., for carrying firearms or other weapons, secured to their belt using a loop of plastic, a metallic material or leather. Although useful, these arrangements are not adjustable to conform physically to the user's body, nor may they be adjusted to accommodate individual holster positioning needs of the user. Accordingly, it is considered important that the user be able to adjust (i) the distance of the holster from the point of attachment to his or her belt, (ii) the inclination of the holster relative to its vertical axis, (iii) the inclination of the holster relative to its vertical plane, and (iv) the distance of the holster's vertical plane from the point of attachment to the user's belt.

One attempt to provide a holster securement device that allows a user to adjust the inclination of the holster comprises a loop portion engageable with the user's belt, a connection portion inclined relative to the loop portions, and a base extending from the free end of the connection portion. The base preferably has a disc member to which the holster may be pivotally secured. In addition, a row of equally spaced pins extends along an edge of the disc member and from one of the member faces. A tooth may be snapped into the spaces between any chosen pair of the pins, thus preventing any further rotation thereof. Also, the tooth is joined to a sliding arm such that the tooth may be disengaged from the pins by pressing an end of the arm. This allows the disc member to be freely rotated upwardly to a desired angular position of the holster. While such arrangements, it has been found, generally operate satisfactorily, the rotation unlocking device is often difficult to operate, especially when the user wears gloves and the locking of the rotation is not sufficiently stables, such as when the holster bumps against an adjacent object on the user's belt, a portion of the user's body, or other obstacle.

Such holster securement devices also permit the height of the holster, i.e., the distance of the holster from the belt, to be varied. This variation is made possible because the disc member for adjusting the holster's inclination is secured to a sliding plate mounted to the base of the securement device and, thereby, arrangeable into at least two positions where the holster is at different distances from the belt. In this manner, the distance of the holster from the belt can be adjusted. While useful, varying the distance in this way, it has been founds, increases the thickness and, therefore, is an encumbrance to the holster securement device. Furthermore, when it is unnecessary to carry a weapon, for instance, while the user is at the office, the entire holster securement device is detached from the user's belt, even after the holster has been removed. This has been found both bothersome to the user and uncomfortable, given the encumbrance of the securement device.

Another conventional securement device for holsters provides a double-jointed connection between the loop attachment and the base to which the holster is secured. This connection includes a substantially double-T shaped joint hinged both to the loop attachment and the base of the holster securement device. It is, therefore, possible to adjust both the inclination of the plane of the base relative to the plane of the loop attachment and the distance between these two planes. Disadvantageously, however, this adjustment can only be accomplished using a tool to turn the screws that lock the hinges. Adjustment of such an arrangement is, therefore, considered laborious and problematic when it must be done, but an appropriate tool is not available.

OBJECTS AND SUMMARY OF THE INVENTION

Accordingly, it is an object of the present invention to provide an adjustable holster securement device that is convenient, easy to operate, comfortable, provides for optimal adjustment, and conforms readily to a user's body.

Another object of the present invention is to provide a holster securement device whereby adjustment of the plane of the holster may be readily accomplished without tools and in such a way as to lock both hinges with a single movement.

A further object of the present invention is to provide a holster securement device where adjustment of the distance of the holster from the point of attachment to the belt may be accomplished without sacrificing the dimensions of the device.

Yet another object of the present invention is to provide a holster securement device in which a relatively small portion of the device remains attached to the belt when the holster is not worn.

Still another object of the present invention is to provide a holster securement device which provides a system for adjusting the inclination of the holster and a locking device that is not only readily accessible to the user, but also assures adequate stability of the chosen position, even when the user is bumped.

According to one aspect of the present invention, an adjustable holster securement device is provided, which comprises an articulated joint for connecting a loop attachment to a holster connection plate. The joint is preferably formed of two oppositely arranged, substantially U-shaped members pivotably engaged in respective seatings, the seatings being generally coaxial with, parallel to and integral with, respectively, the loop attachment and the connection plate. The device also comprises a tie-rod operating generally parallel to the seatings for joining the substantially U-shaped members to one another at a variable mutual distance. Additionally, a device is provided between the substantially U-shaped members and the seatings for locking the articulated joints operated by the tie-rod, so as to control locking or release of the joint.

Specifically, the seatings are formed in pairs on sleeves extending along adjacent sides of the loop attachment and the connection plates, and each of the substantially U-shaped members has two relatively parallel, spaced apart pins engageable with these seatings. Toothed portions axially engageable with one another are also provided at the base of the pins and at the ends of the sleeves.

It is preferred that the loop attachment include a seating for engaging a bracket extending at right angles relative to sleeves arranged along one of its sides. The bracket has a flexible tongue with an enlarged end selectively engageable within openings formed along the seating in the longitudinal direction, such that, upon engagement of the tongue with one or the other of the openings, the height of the holster securement device may be varied.

Alternatively or concurrently, the inclination of the holster may be adjusted by providing one or more notches along an edge of the rotatable disc carrying the holster, the notches being engageable with a relatively small cylinder that is integral with the connection plate and constrained to slide a radial direction relative to the disc. An arm sliding elastically parallel to the sleeve and extending along the side of the plate has a side with two concave portions of different depths. When rotation of the disc is locked, the less deep of the concave portions of the arm is maintained elastically in contact with the small cylinder. When the arm is then pressed to overcome the elastic reaction, the deeper of the concave portions of the arm comes to be in contact with the small cylinder, thus permitting the cylinder to slide, move out of the notch on the edge of the discs, and permit the latter to rotate.

BRIEF DESCRIPTION OF THE DRAWINGS

A specific, illustrative holster securement device, in accordance with the present invention, is described below with reference to the accompanying drawings, in which.

The same numerals are used throughout the drawing figures to designate Similar elements. Still other objects and advantages of the present invention will become Apparent from the following description of the preferred embodiments.

DETAILED DESCRIPTION OF THE PREFERRED EMBODIMENTS

Figure 1:
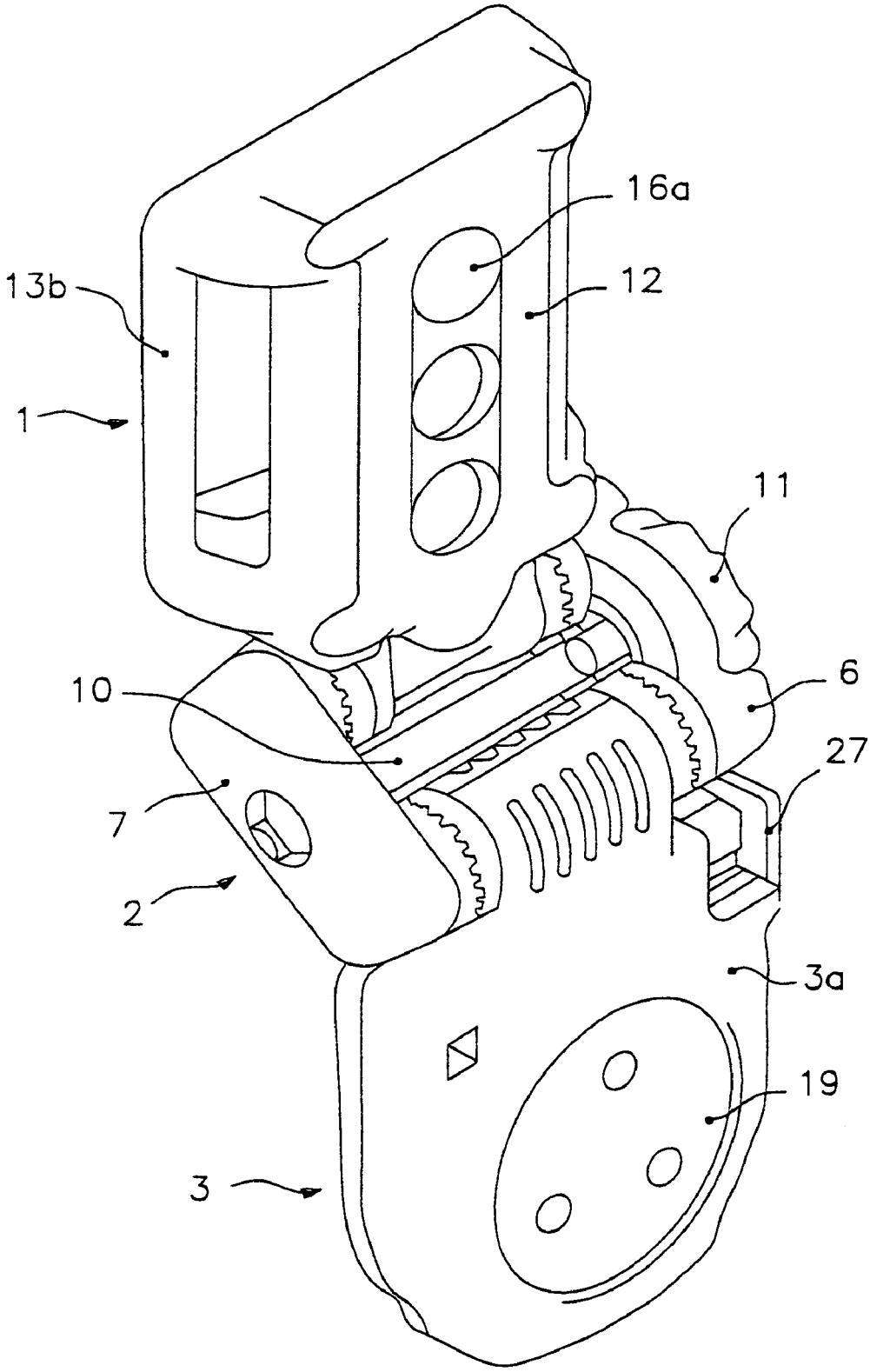
FIG. 1 is a perspective view of an adjustable holster securement devices, in accordance with one aspect of the present invention.
Figure 2:
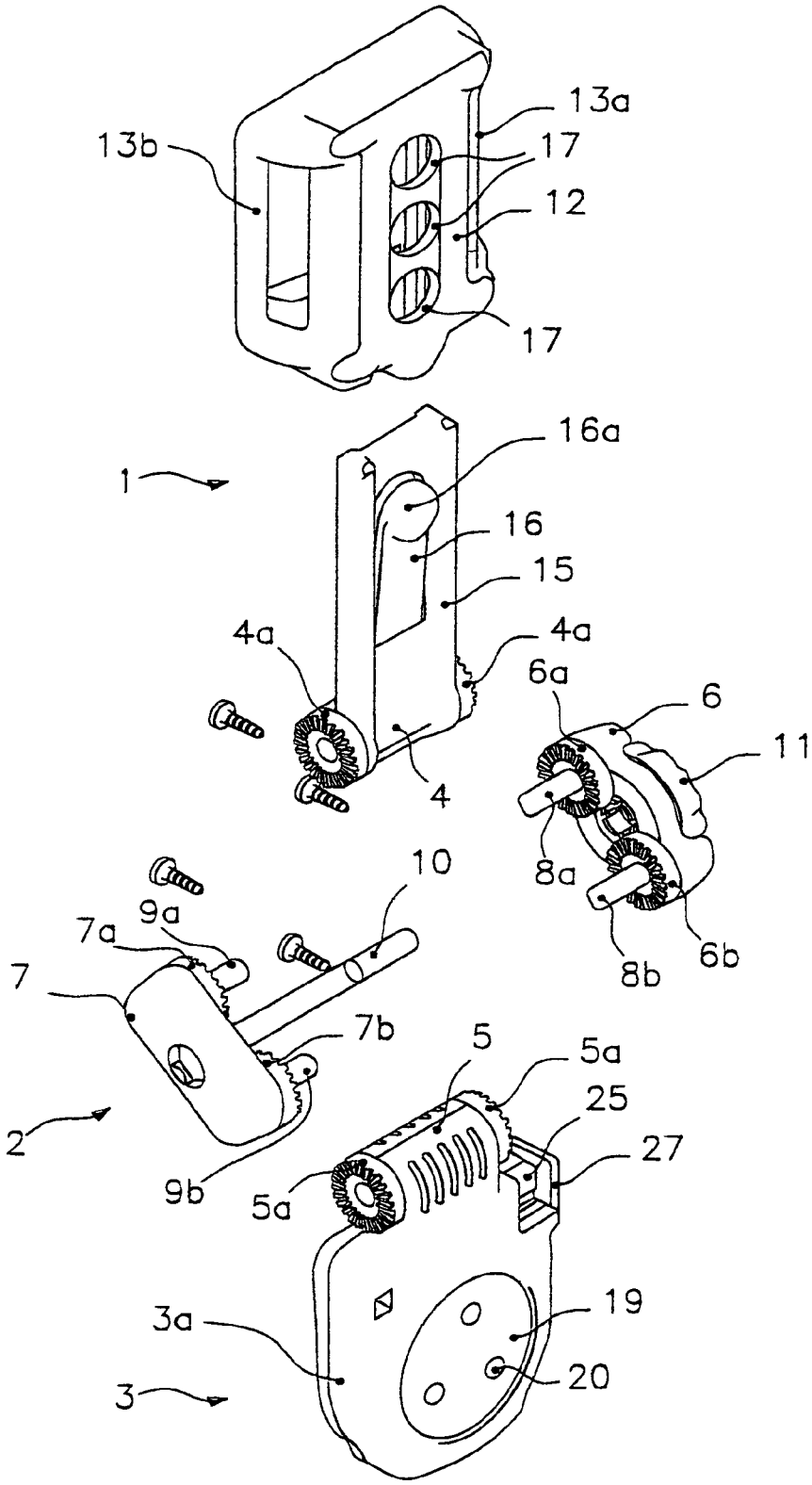
FIG. 2 is a partially exploded view of the holster securement device shown in FIG. 1.
Figure 3:
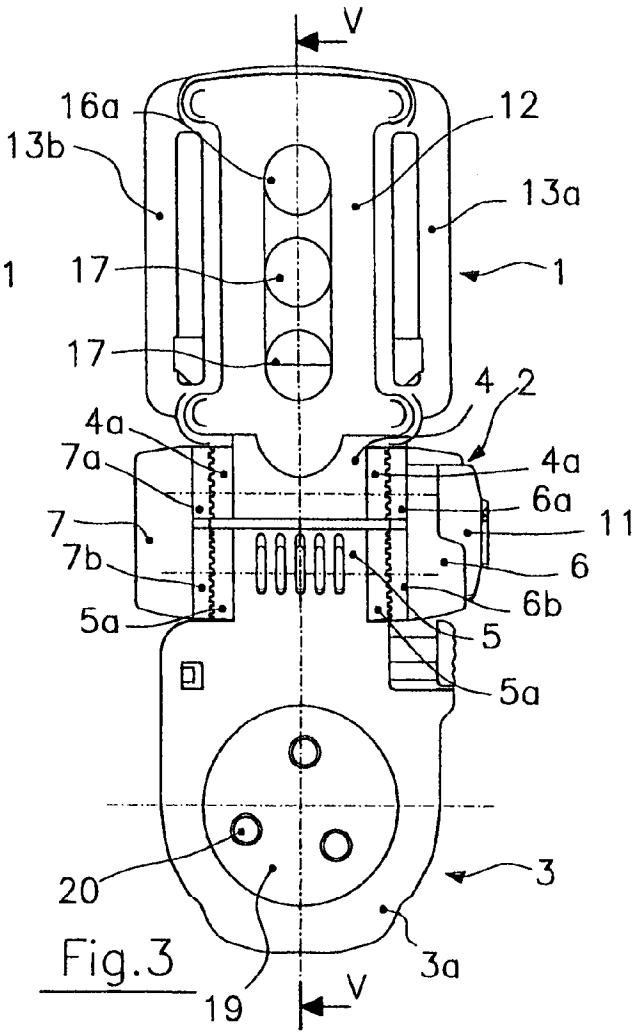
FIG. 3 is a front elevational view of the device shown in FIG. 1.
Figure 5:
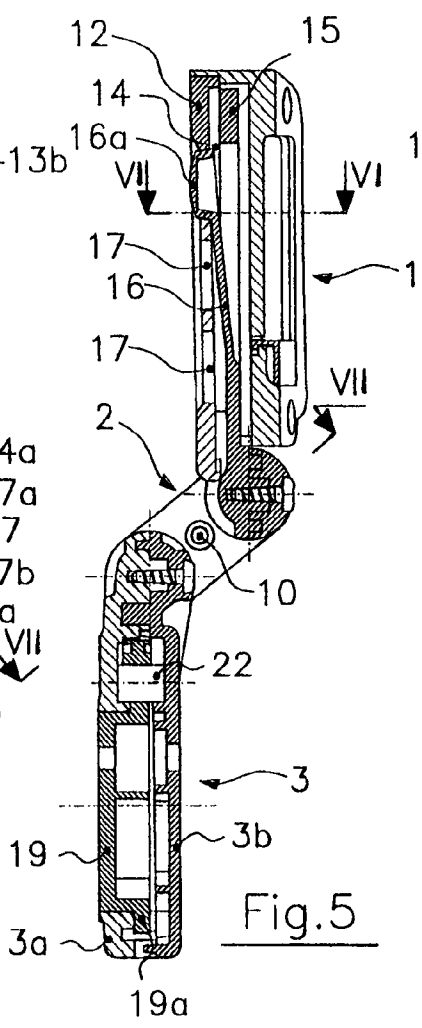
FIG. 5 is a sectional view taken along lines V-V of FIG. 3.
Figure 4:
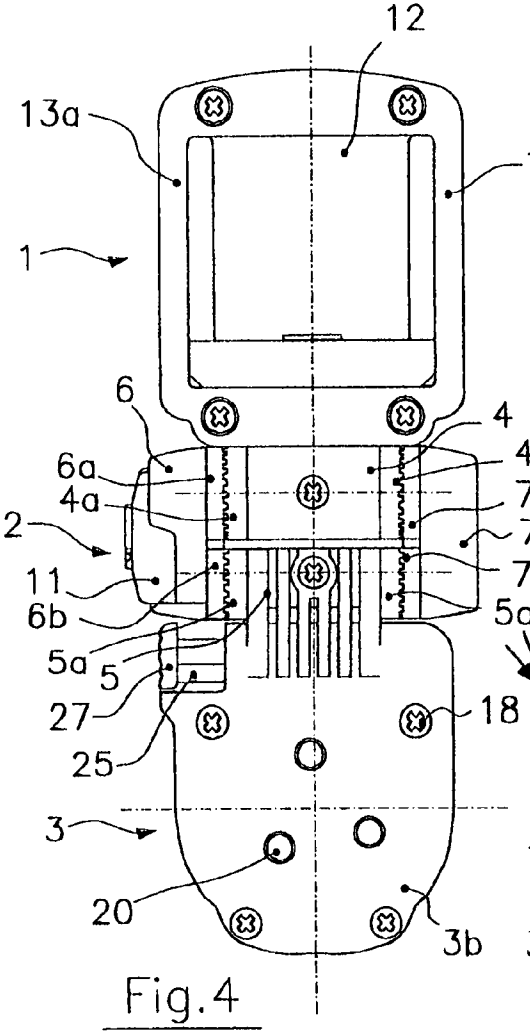
FIG. 4 is rear view of the device shown in FIG. 1.
Figure 6:
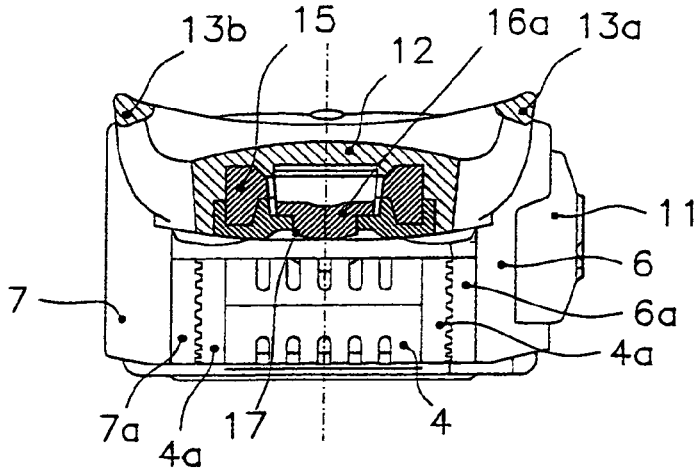
FIG. 6 is a sectional view taken along lines VI-VI of FIG. 3.
Figure 7:
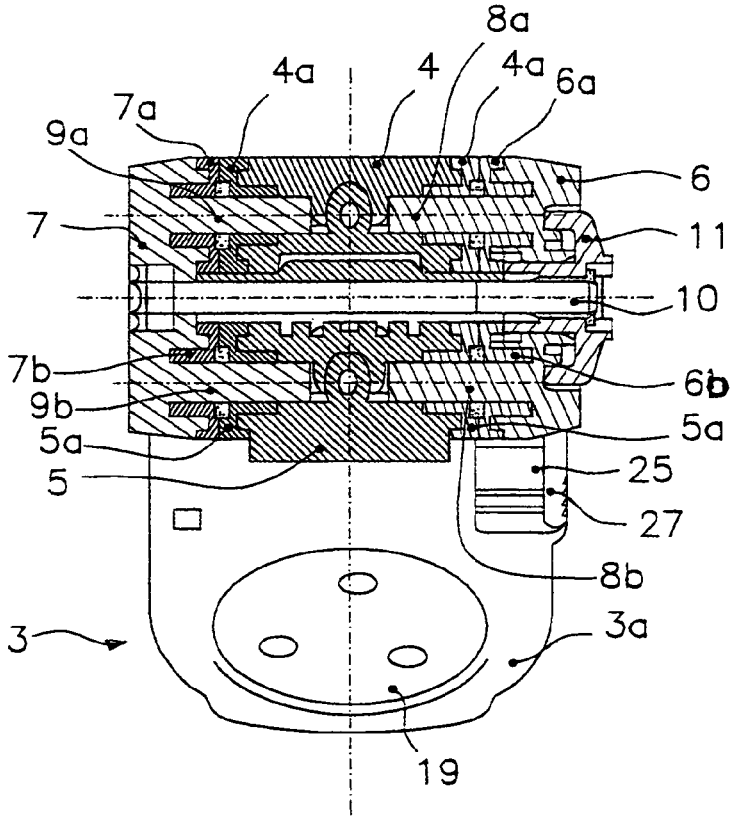
FIG. 7 is a sectional view taken along lines VII-VII of FIG. 3.

Referring now to the drawings and, more particularly, to FIGS. 1-9, there is shown generally a specific, illustrative adjustable holster securement device, in accordance with the present invention. According to one embodiment, illustrated generally in FIG. 1, the device is substantially made of three components, including a loop attachment 1 for securing the holster securement device to the user's belt, a connection plate 3 to which the holster can be attached, and an articulated joint 2 for connecting loop attachment 1 to the connection plate 3 in an articulated manner.

Preferably, a pair of sleeves 4, 5, generally parallel to one another and joined by articulated joint 2, extend from the sides of loop attachment 1 and connection plate 3. Frontally toothed gears 4*a*, 5*a* delimiting respective rotational seatings are also provided at the ends of sleeves 4, 5, respectively.

The seatings in the sleeves form part of articulated joint 2, which also comprises two substantially U-shaped members, each of which is made up of an end element 6, 7. A pair of pins 8*a,b* and 9*a,b*, respectively, extend from end elements 6, 7, each being engaged from opposite sides with the seatings of the sleeves 4 and 5, thereby forming an articulated joint with two hinges having parallel axes. Frontally toothed gears 6*a, b* and 7*a, b* are arranged at the base of pins 8*a, b* and 9*a, b* coaxially relative thereto. Gears 6*a, b* and 7*a, b* are preferably designed to engage corresponding frontally toothed gears 4*a* and 5*a* at the ends of the sleeve seatings. A stem 10 extends from one of the two end elements 6 or 7 and includes a threaded end capable of engaging a corresponding seating, not shown, on a locking nut 11 pivotally connected to mother end element 6 or 7 of articulated joint 2. Stem 10 is parallel to the axes of sleeve seatings 4 and 5 and extends between them.

Rotation of locking nut 11 causes it to move. e.g., screw onto, stem 10, the locking nut and stem thus operating as a tie rod for gradually drawing the substantially U-shaped members closer to one another and, thereby, bringing frontally toothed gears 4*a* 5*a*, at the ends of sleeve seatings 4, 5, closer to the corresponding frontally toothed gears 6*a,b* and 7*a,b*, until they eventually engage one another and effectively lock the articulated joint. It is, therefore, possible to choose the preferred angular orientation for connection plate 3, and also of the plane in which the holster lies, about the axis of the seating of sleeve 5, as well as the preferred angular orientation of the seating relative to the seating of sleeve 4, thereby displacing the planes of loop attachment 1 and connection plate 3 relative to one another. Once the preferred angular orientations have been chosen, articulated joint 2 can be locked by simply rotating the locking nut 11 as described above.

The loop attachment comprises, for instance, a box-shaped body 12 with belt passages 13*a*, 13*b* formed along two sides. An interior portion of body 12 defines a seat 14 for a bracket 15 extending radially from sleeve 4 and slidingly housed within seat 14. A flexible tongue 16 is cut from the bracket and is so shaped as to be slightly inclined relative to a selected plane of bracket 15. On one face of the body 12 are some axially aligned openings, (for example, three openings and of circular shape, while a free end of tongue 16 has an enlargement 16*a* shaped suitably for snapping into reversible engagement with one of openings 17, while partially projecting therefrom. When adjustment is desired of the length of the holster securement device, i.e., the distance of the holster from the belt engaged with the loop attachment 1, all that need be done is to slide the bracket relative to box-like body 12 and press with fingers on head 16*a* of the tongue to disengage the tongue from the opening in which it is engaged and cause it to slide until it engages another of the openings. e.g., opening 17. Connection plate 3, to which the holster is attached, is formed by shells 3*a* 3*b* that may be secured to one another by screws 18 to clasp externally projecting edge 19*a* of disc-shaped body 19 between them. The disc-shaped body has through holes 20 for screw connection with and to the holster.

Figure 8:
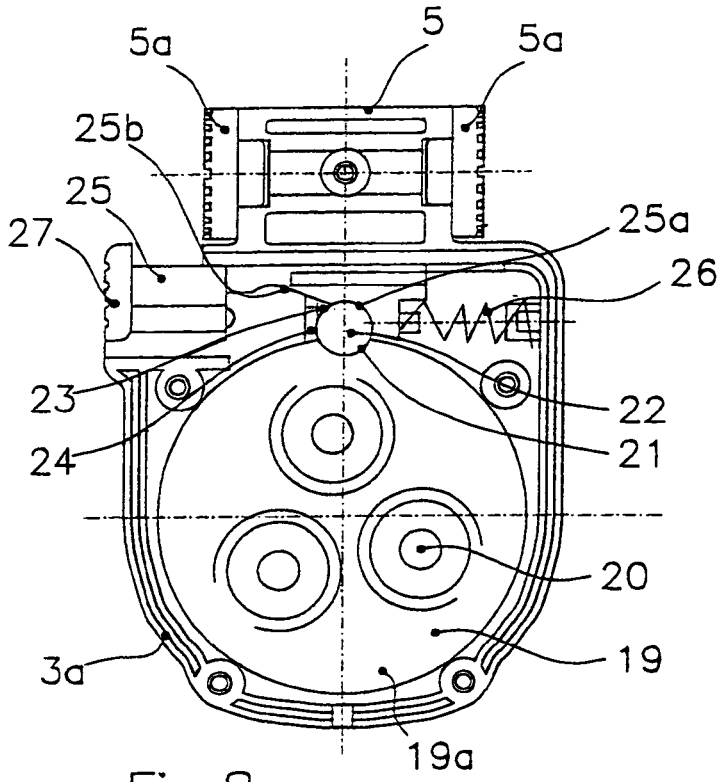
FIG. 8 is a plan view of the base to which the holster of FIG. 1 is attached.

As shown in FIG. 8, a cavity 21 is formed along edge 19*a*, such cavity engaging a relatively small cylinder 22 generally perpendicular to shells 3*a*, 3*b* and formed integrally therewith, though it may slide in a radial direction relative to disc-shaped body 19. For this purposes, a seating 23 is provided on an inner face of shell 3*a*, the seating being defined by a U-shaped wall 24 within which one end of small cylinder 22 is arranged. When at rest, the small cylinder is prevented from sliding in the seating 23 by an arm 25 that acts elastically against it. Arm 25 extends slidingly between shells 3*a* and 3*b* and generally parallel to sleeve 5 between the sleeve and the disc-shaped body. An edge portion 25*a* of arm 25 is shaped and made suitably concave so as to bear against small cylinder 22 and thus prevent it from sliding.

Figure 9:
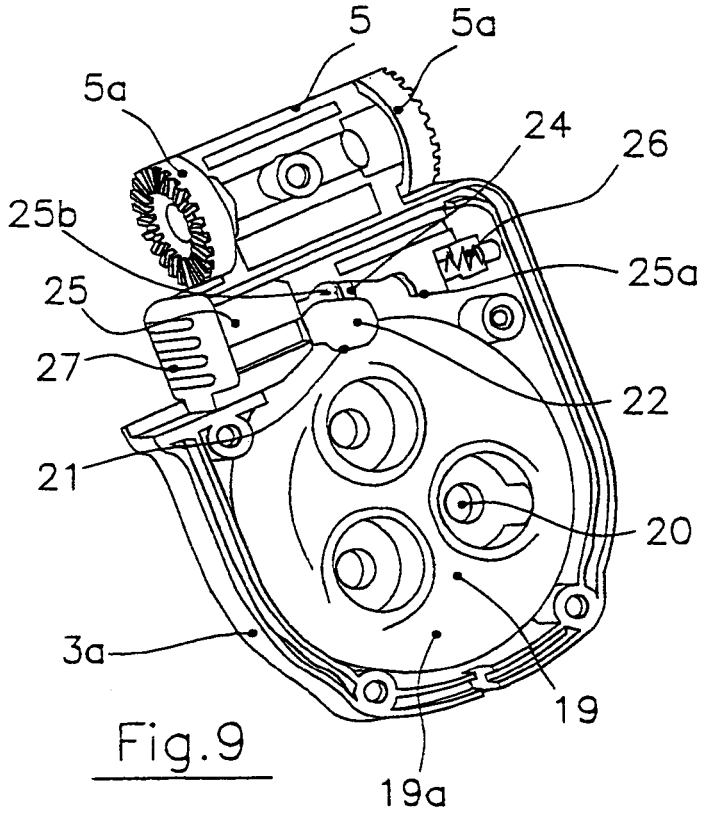
FIG. 9 is a perspective view of the base shown in FIG. 8 with the device for locking the rotation in the release position.

A spring 26 is arranged between a free end of arm 25 and the edge of shell 3*a* to force concave portion 25*a* elastically against small cylinder 22. A further and more concave portion 25*b* is formed adjacent to the concave portion along with the edge of arm 25 in such a manner as to not abut against cylinder 22, which is therefore free to slide. When the small cylinder is to be released, it is generally sufficient to press with a finger on pushbutton end 27 of arm 25, projecting sideways from the connection plate 3, to overcome the elastic reaction of spring 26 and, Thereby, cause arm 25 to slide and bring concave portion 25*b* into correspondence with the small cylinder (FIG. 9). As the cylinder is no longer being retained, it can therefore slide in a radial direction relative to disc-shaped body 19. Radial displacement of the small cylinder allows the disc-shaped body 19 to rotate, so that the holster, which is attached to it, can be arranged in any inclined position that is desired by the user.

In this manner, the stability of the holster in the chosen inclined position is assured by the resistance to relative sliding between the disc-shaped body and the cylinder, which is forced by arm 25 against edge 19*a*. A relatively moderate force exerted on the holster can modify this position and also return the holster back to a locked position. This course is often appropriate, especially when the user wishes to make fine adjustments to the variable configuration of the holster with one hand. Otherwise, should it be desired to have several stable locking positions at different inclinations, it is deemed sufficient to provide additional notches 21 at appropriate angular spacings along edge 19*a*.

Overall, the adjustable holster securement device according to the present invention overcomes the disadvantages of conventional holster securement devices by incorporating the system for regulating the height of such device in the loop attachment. This arrangement not only provides significant reduction of the encumbrance of the connection plate, but it also minimizes the number of components of the holster securement device that remain attached to the belt in all the conditions in which it is not necessary for the user to carry a weapon. Indeed, the bracket may be completely withdrawn from box-shaped body 12, such that only the body remains attached to the belt in all situations.

Various modifications and alterations to the present invention may be appreciated based on a review of this disclosure. These changes and additions are intended to be within the scope and spirit of the invention as defined by the following claims.

The invention claimed is:

1. An adjustable holster securement device comprising a loop attachment for securing the holster to a user's belt, a connection plate to which a holster can be attached, and an articulated joint for joining the loop attachment to the connection plate in an articulated manner, wherein the articulated joint is formed by two substantially U-shaped members pivotably engaged in respective seatings on opposite sides thereof, the seatings being coaxial with, parallel to and integral with, respectively, the loop attachment and connection plate, and further comprising at least one tie-rod acting generally parallel to the seatings to connect the substantially U-shaped members to one another and a device for locking the articulated joint arranged between the substantially U-shaped members and the seatings, and operable by the tie-rod to control locking and release of the articulated joint.

2. The device set forth in claim 1, wherein each of the substantially U-shaped members comprises an end element and two generally parallel, spaced apart pins extending at right angles therefrom, the coaxial seatings extending along adjacent sides of the loop attachment and the connection plate, the seatings being formed in sleeves with frontally toothed ends, a correspondingly toothed part being provided at the base of each pin for engaging a respective toothed end of the sleeves when, due to action of the tie-rod, the substantially U-shaped members are brought closer to one another, thereby locking the rotation of the pins within their respective seatings.

3. The device set forth in claim 1, wherein the at least one tie-rod comprises a pin that extends from one of the substantially U-shaped members and engages by a screw thread with a seating in a rotatable locking nut pivotably mounted on the other substantially U-shaped member.

4. The device set forth in claim 1, wherein a bracket slidingly engaged with a seating of the loop attachment extends from the sleeve along a side of the attachment, snap-type fasteners being provided on the bracket to permit the attachment to be reversibly locked in different positions relative to the seating.

5. The device set forth in claim 4, wherein a flexible tongue is formed on the bracket, the tongue projecting at an angle therefrom and having an enlarged end selectively and reversibly engageable with corresponding longitudinally aligned openings formed on the seating.

6. The device set forth in claim 1, wherein the loop attachment has passages along opposing sides thereof.

7. The device set forth in claim 1, wherein the connection plate comprises a disc member for supporting the holster mounted pivotably on the plate and provided with at least one engagement cavity along an edge thereof, an elastically slidable arm generally parallel to the sleeve extending along one side of the plate, and a body constrained to slide in a direction at right angles to the arm, the arm having two concave portions of different depth on one of its sides, the concave portions defining a locking position of the rotation of the disc member, in which the relatively less deep concave portion of the arm abuts the body, so as to maintain the arm in the seating, and a rotation release position, in which the deeper concave portion is brought into correspondence with the body, thereby allowing the body to slide in a generally radial direction relative to the disc member in order to disengage the body from the seating.

8. The device set forth in claim 7, wherein the connection plate comprises two shells, within which both the rotatable disc and the sliding arm are mounted, the latter being arranged between an edge of the disc member and the sleeve, extending along one side of the plate, and projecting sideways beyond it with a pressure operated end.

9. An adjustable holster securement device comprising a loop attachment for securing the holster to a user's belt, a connection plate to which the holster can be attached, and an articulated joint for connecting the loop attachment to the connection plate in an articulated manner, the axis of articulation of the joint being generally parallel to the connection elate for movement toward and away from the user's body, wherein the loop attachment has a seating within which a bracket extending from the joint is slidingly engaged, the bracket being provided with a snap fastener for locking it reversibly in different positions relative to the seating.

10. The device set forth in claim 9, wherein a relatively flexible tongue is formed on the bracket, the tongue projecting at an angle therefrom and having an enlarged end selectively and reversibly engageable with corresponding longitudinally aligned openings along the seating.

11. An adjustable holster securement device comprising a loop attachment for securing the holster to a user's belt, a connection plate to which the holster is attached, and an articulated joint for connecting the loop attachment to the connection plate in an articulated manner, the axis of articulation of the joint being generally parallel to the connection plate for movement toward and away from the user's body, wherein the connection plate comprises a disc member supporting the holster and pivotably mounted to the plate, at least one engagement cavity along an edge thereof, an elastically slidable arm generally parallel to the axis of articulation of the joint, and a body constrained to slide in a direction at right angles to the arm, the arm having concave portions of different depth on one of its sides which define a disc rotation locking position, in which the generally less deep concave portion of the arm abuts the body to maintain it in the seating, and a rotation release position, in which the generally deeper concave portion is brought into correspondence with the body, thereby allowing the body to slide in a generally radial direction relative to the disc member and disengage from the seating.

12. The device set forth in claim 11, wherein the plate comprises two shells, within which both the rotatable disc and the sliding arm are mounted, the latter being arranged between an edge of the disc member and the sleeve, extending along one side of the plate, and projecting sideways beyond it with a pressure operated end.

* * * * *